United States Patent [19]

Akahane

[11] Patent Number: 4,606,098

[45] Date of Patent: Aug. 19, 1986

[54] PENDULUM ROD IMMOBILIZING DEVICE

[75] Inventor: Masahiro Akahane, Nagano, Japan

[73] Assignee: Rhythm Watch Co., Ltd., Tokyo, Japan

[21] Appl. No.: 654,034

[22] Filed: Sep. 21, 1984

Related U.S. Application Data

[63] Continuation of Ser. No. 351,435, Feb. 23, 1982, abandoned.

[30] Foreign Application Priority Data

Feb. 26, 1981 [JP] Japan ..... 56-26539[U]

[51] Int. Cl.[4] ..... A44B 21/00

[52] U.S. Cl. ..... 24/326; 368/300; 368/183

[58] Field of Search ..... 368/134–139, 368/183, 300; 84/484; 24/255 R, 326, 545, 67.7, 67.3, 326

[56] References Cited

U.S. PATENT DOCUMENTS

| | | | |
|---|---|---|---|
| 3,100,326 | 8/1963 | Buck | 24/67.7 |
| 3,309,052 | 3/1967 | Borisof | 24/255 R |
| 3,808,793 | 5/1974 | Ebdon | 84/484 |
| 4,277,863 | 7/1981 | Faneuf | 24/545 |
| 4,397,577 | 8/1983 | Bauer | 24/545 |

FOREIGN PATENT DOCUMENTS

| | | | |
|---|---|---|---|
| 73705 | of 0000 | Fed. Rep. of Germany | 368/183 |

*Primary Examiner*—Gene Mancene
*Assistant Examiner*—David I. Tarnoff
*Attorney, Agent, or Firm*—Koda and Androlia

[57] ABSTRACT

A pendulum rod immobilizing device for immobilizing the pendulum rod of a clock in order to prevent damage to the clock by motion of the pendulum rod during transport. The pendulum rod is immobilized by engagement with a pendulum rod retainer provided on the movement case of the clock and is released by the operation of a release member provided on the pendulum rod retainer. The pendulum rod retainer is provided at a position outside the normal range of swing of the pendulum rod so that the immobilizing effect is obtained only when the pendulum rod is deliberately moved considerably beyond its normal range of swing and that the pendulum rod retainer does not interfere with the swing of the pendulum rod during normal use.

1 Claim, 11 Drawing Figures

PENDULUM ROD IMMOBILIZING DEVICE

This is a continuation of application Ser. No. 351,435, filed Feb. 23, 1982, now abandoned.

BACKGROUND OF THE INVENTION 1. Field of the Invention

This invention relates to a pendulum rod immobilizing device for a pendulum clock and more particularly to an improved pendulum rod immobilizing device for retaining the pendulum rod of a clock during storage or transport of the clock.

2. Description of the Prior Art Pendulum clocks which use the free swinging motion of a pendulum as a time standard are universally known. In recent years, moreover, there have been manufactured and sold high-precision quartz clocks employing quartz oscillators which are fitted with ornamental pendulums. In these pendulum clocks, there is provided a pendulum rod suspended vertically from the clock movement. Being relatively large with respect to the clock movement, the pendulum rod is apt to strike against neighboring parts of the clock during storage or transport with enough force to break or put them out of order.

Conventionally this problem has been coped with by restraining and fixing the pendulum rod during packing through the use of a resilient member or material such as a clamp, rubber, sponge or foamed styrol so as to prevent the movement of the pendulum rod during transport.

This conventional method of immobilizing the pendulum rod is, however, disadvantageous in that it requires the provision of a separate fastening clamp or resilient material and therefore leads to an increase in the number of components involved and, even more importantly, to an increase in the number of fabrication steps required. Also, with the conventional method, the pendulum rod is not always securely immobilized and it frequently happens that the pendulum breaks free during transport to damage the clock. Another problem has been that the work of freeing the pendulum rod from the restraining member or material prior to use is troublesome.

SUMMARY OF THE INVENTION

The object of the present invention is to provide an inexpensive and reliable pendulum rod immobilizing device by providing a pendulum rod retainer on the dust case of the clock at the time of fabricating the clock.

In order to achieve this object, the present invention provides, on the dust cover a pendulum clock at a position outside the normal range of swing of the pendulum rod, a pendulum rod immobilizing device comprising a pendulum rod retainer and at least one guide for guiding the pendulum of the clock into said pendulum rod retainer, said pendulum rod retainer having a resilient member formed on said movement cover, and a catch for engaging said pendulum rod and a release member for freeing said pendulum rod from engagement with said catch provided on said resilient member, whereby said pendulum rod can be guided into said pendulum rod retainer along said at least one guide to be immobilized by the engagement of said pendulum rod with said catch.

DESCRIPTION OF PREFERRED EMBODIMENTS

The present invention will hereafter be described in further detail with reference to the accompanying drawings.

Figure 1:
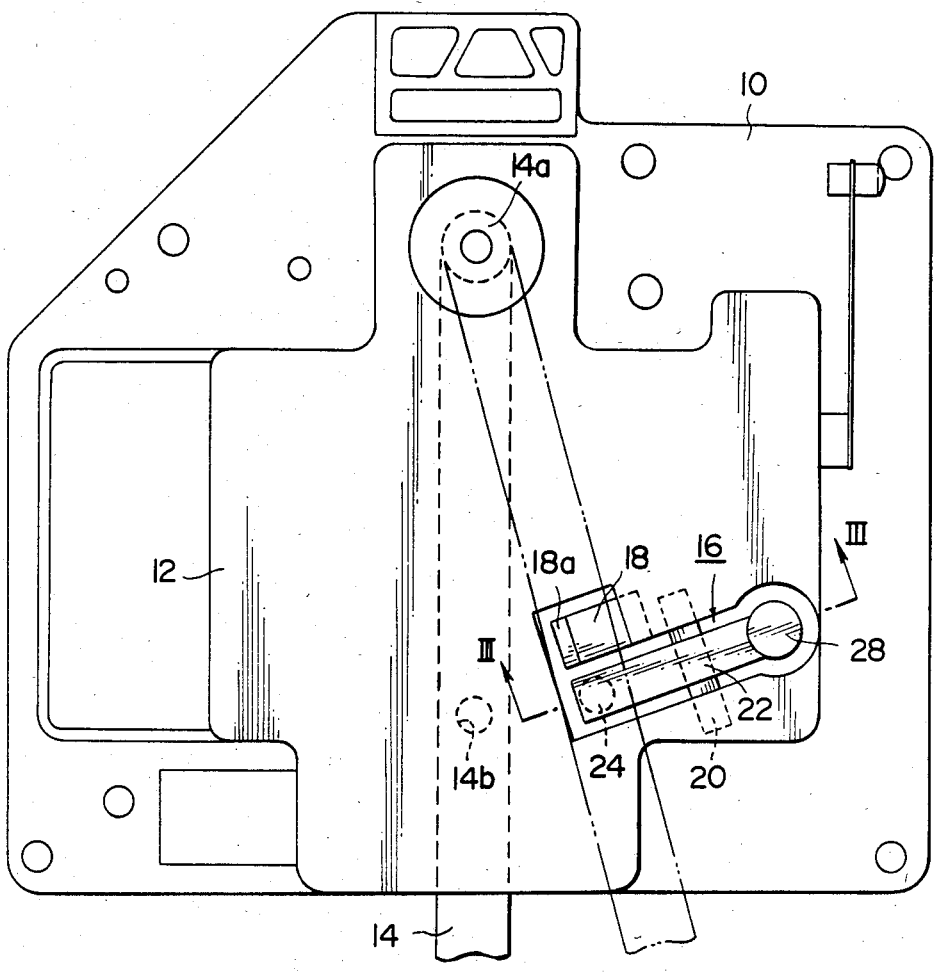
FIG. 1 is a rear view of a pendulum clock fitted with a pendulum rod immobilizing device according to a first embodiment of the present invention.

FIG. 1 shows a first embodiment of the pendulum rod immobilizing device in accordance with the present invention.

In accordance with a well-known structure, a clock movement is mounted on a base plate 10 and enclosed within a dust case, namely a dust cover 12 in the illustrated embodiment, so as to prevent the intrusion of dust or the like into the movement. A pendulum rod 14 is suspendedly supported within the dust cover 12 so as to be operatively connected with the clock movement. In the illustrated embodiment, one end 14*a* of the pendulum rod 14 is suspended from a spindle supported at its opposite ends by bearings provided in the base plate 10 and the dust cover 12 and is swung by power received from the clock movement, which in this case is a quartz clock movement. A pendum bob (not shown) is provided at the other end of the pendulum rod 14 to complete the structure of this ornamental pendulum device.

The characterizing feature of the present invention lies in the provision on the dust cover 12 of a pendulum rod retainer 16 and a guide 18 for guiding the pendulum rod 14 into the retainer 16. In the illustrated embodiment the pendulum rod retainer 16 and the guide 18 are formed of plastic integrally with the dust cover 12.

Figure 2:
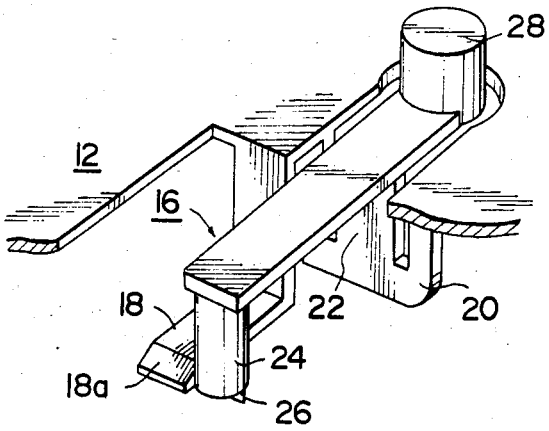
FIG. 2 is a perspective view of the important part of the device shown in FIG. 1.
Figure 3:
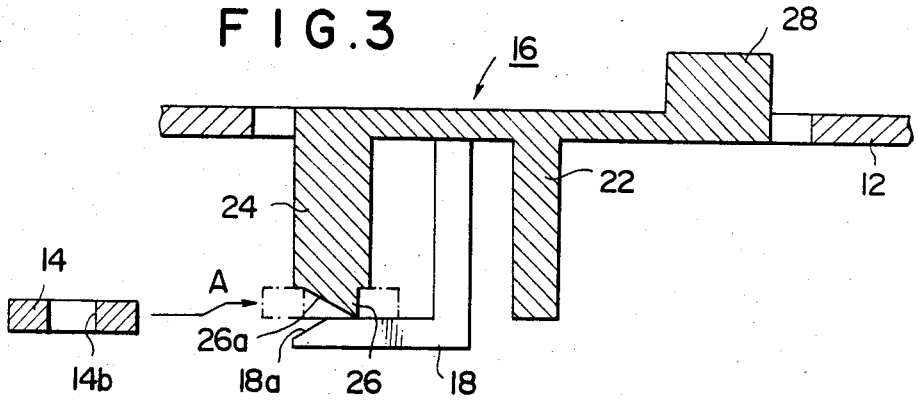
FIG. 3 is a sectional view taken along line III—III in FIG. 1.

FIG. 2 is a perspective view of the pendulum rod retainer 16 and the guide 18 while FIG. 3 is a sectional view of the important part of these same members. The first embodiment of the invention will now be described in detail with respect to these figures.

The pendulum rod retainer 16 has a support member 20 which, in view of the integrated structure of the retainer 16 and the dust cover 12 in this embodiment, is formed to extend vertically downward from the outer wall of the dust cover 12 (i.e. in the direction of the base plate 10) in the shape of the two outer prongs of a three-pronged wall. Extending from the support member 20 is a resilient member 22 formed of the third and central prong of the three pronged-wall and an arm extending parallel to the outer wall of the dust cover 12 like the crossbar of the letter T with respect to the central prong. The resilient member 22 is formed integrally of plastic with the dust cover 12 and is able to rock about the support member 20 as its pivot. At one end of the resilient member 22 is formed a pendulum rod catch which, as shown in the drawings, is formed integrally with the resilient member 22 to extend in the direction of the base plate 10 in the shape of a cylinder having a claw 26 for engagement with the pendulum rod 14 formed at its free end. One face of the claw 26, namely the face which opposes the pendulum rod 14, is formed as an inclined guide face 26*a* which facilitates the action of catching the pendulum rod 14.

The pendulum rod retainer is further provided with a release member 28 for releasing the engagement of the catch 24 with the pendulum 14. In the illustrated embodiment, the release member 28 is integrally formed as a cylindrical protrusion on the end of the crossbar of the resilient member 22 opposite that on which the catch 24 is provided. As the release member 28 protrudes above the outer wall of the dust cover 12, the user can easily cause the catch 24 to rise away from the pendulum rod 14 by pressing the release member 28 downward.

A guide 18 is provided in the vicinity of the pendulum rod retainer 16 for guiding the pendulum rod 14 into the retainer. In the illustrated embodiment, this guide 18 is formed integrally with the dust cover 12 and has at its free end an inclined guide face 18*a* with an angle of inclination opposite that of the guide face 26*a*. Therefore, as can be seen from FIG. 3, the two guide faces 26*a* and 18*a* together form an inlet guide with an opening facing toward the pendulum rod 14.

As is clear from FIG. 1, the pendulum rod retainer 16 and the guide 18 are provided at positions that are out of the normal path of swinging motion of the pendulum rod 14 when the clock is in the normal state of use. As a consequence, these members in no way interfere with the swing of the pendulum rod 14 in the normal state of use. As for the positioning of these members outside the range of swinging motion of the pendulum rod, this can of course be accomplished either by locating them outside the angle of swing within the same plane as the plane of swinging motion or by locating them in a different plane from the plane of swinging motion.

The pendulum rod immobilizing action of the embodiment of the invention shown in FIG. 1 and having the structure described above will now be described with reference to FIGS. 3 and 4.

FIG. 3 shows the manner in which the pendulum rod is immobilized. At the time of packing the completed clock for shipment, the pendulum rod 14 is pushed in the direction of arrow A to move it beyond its normal range of swing in the direction of the retainer 16. As a result, the pendulum rod 14 rides onto the guide face 18*a* of the guide 18 and comes into contact with the guide face 26*a* of the claw 26 on the catch 24. Then when the pendulum rod 14 is moved further in the same direction, it pushes the catch 24 upward eventually coming to the position shown in broken lines in FIG. 3. At this time the catch 24 is pushed down under the force of restoration of the resilient member 22 causing the claw 26 to engage with an engagement hole 14*b* provided in the pendulum rod 14. As a consequence, the pendulum rod 14 is securely immobilized by the pendulum rod retainer 16 in the position shown in two-dot chain lines in FIG. 1.

The immobilization of the pendulum rod 14 can thus be accomplished simply by moving the rod in the prescribed direction. This operation can be performed quickly and without need of any type of clamping device or retaining material.

Figure 4:
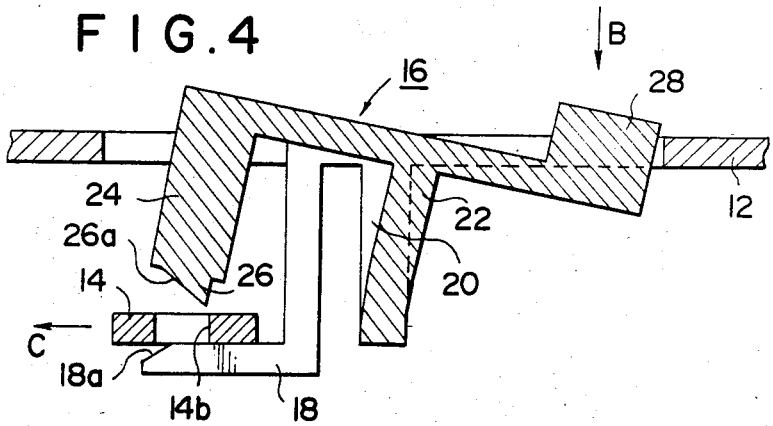
FIG. 4 is an explanatory view showing the released state of the first embodiment shown in FIG. 1.

When it is desired to release the pendulum rod 14 so as to put the block into condition for normal use, the user presses the release button 28 in the direction of the arrow B in FIG. 4. This causes the resilient member 22 to bend so that the catch 24 rises to allow the rod 14 to slip free of the claw 26 under its own weight and then continue to move in the direction of the arrow C until reaching the position for normal use. The operation of releasing the pendulum in accordance with the device of the present invention is thus extremely simple and, moreover, since the pendulum rod retainer 16 is formed integrally with the dust cover 12, the method of carrying out this operation can be written at a conspicuous position on the dust cover for the convenience of the user.

Figure 5:
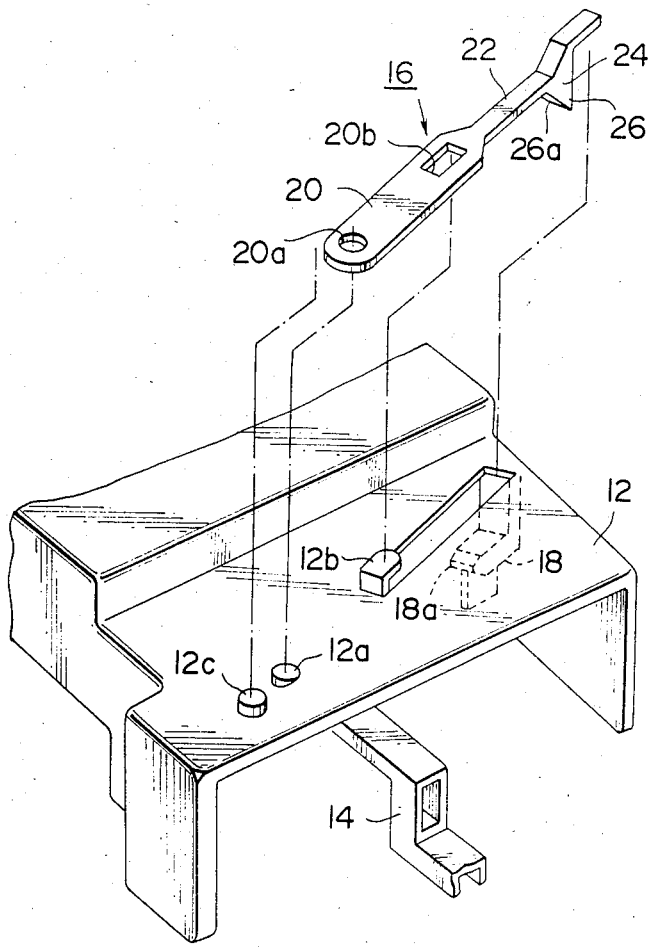
FIG. 5 is a perspective view of the important part of a pendulum rod immobilizing device according to a second embodiment of the present invention.

A second embodiment of the pendulum rod immobilizing device according to this invention is shown in FIG. 5. This embodiment is characterized by the fact that the pendulum rod retainer 16 is separately formed of plastic etc. so as to be freely attachable to and detachable from the dust cover 12. For simplicity of explanation, members of the second embodiment which are the same as or correspond to members of the first embodiment are denoted by the same reference numerals. The support member 20 of the pendulum rod retainer 16 is provided with a support hole 20*a* and a support slot 20*b* which engage with a tapered post 12*a*, a hook 12*b* and a stopper post 12*c*, all of which are provided on the dust cover 12, in the manner shown in FIGS. 6 and 7. Through this engagement, the pendulum rod retainer 16 can be fixed to the dust cover 12 at a predetermined position. Extending from the support member 20 is the resilient member 22 having at its tip the catch 24 which, in this embodiment, is nearly triangular in vertical section. At the tip of the catch 24 is the claw 26 for engagement with the pendulum rod 14. The release member 28 is formed as a tongue-shaped extension from the top of the outer end of the catch 24. By pulling upward on the release member 28, the user is able to free the pendulum rod 14 from its immobilized state.

The operation of the pendulum rod immobilizing device in accordance with the second embodiment of the invention described above will now be explained with reference to FIGS. 6 and 7.

Figure 6:
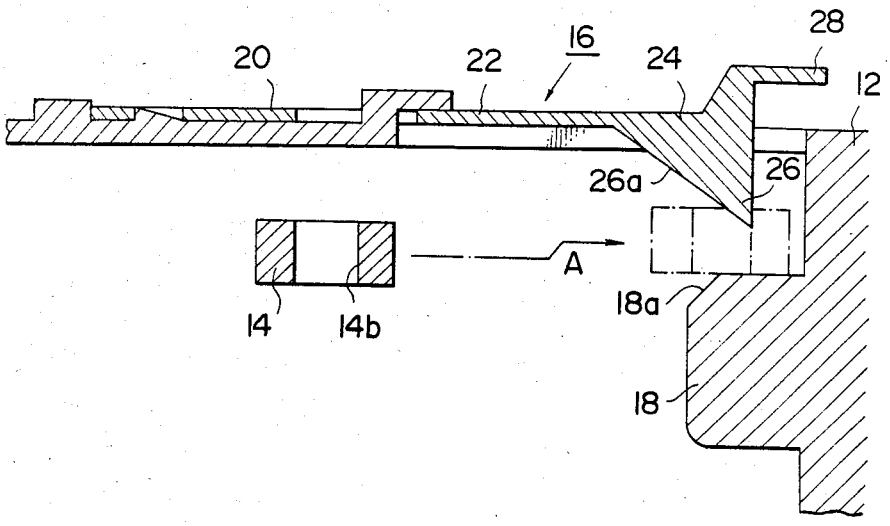
FIGS. 6 and 7 are explanatory views showing the operation of the second embodiment.

FIG. 6 shows the pendulum rod in the immobilized state. As in the first embodiment, the pendulum rod 14 is immobilized by pushing it in the direction of the arrow A so as to bring the engagement hole 14*b* into the vicinity of the guide faces 26*a* and 18*a*, whereafter the pendulum rod 14 is further moved in the same direction to first push up the catch and then to allow the claw 26 to engage with the engagement hole 14*b* so as to securely immobilize the pendulum rod 14.

Figure 7:
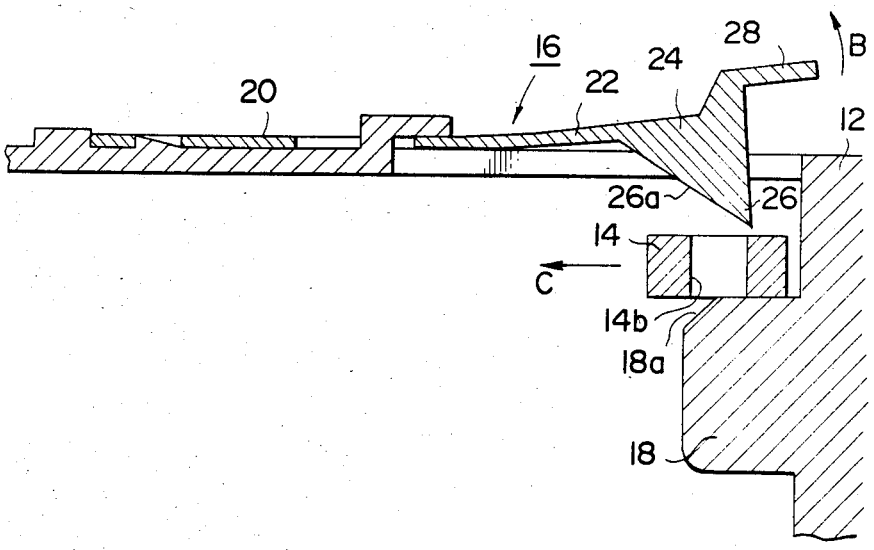

To release the pendulum rod 14, the release member 28 is pulled upward as shown by the arrow B in FIG. 7. This causes the claw 26 to rise out of the engagement hole 14*b*, thus allowing the pendulum rod 14 to return to the normal state for use.

Although in the embodiments described above, a dust cover was used as the dust case, this invention is not limited to such an arrangement. It is also possible to use any other type of dust case, for example, one in which a portion of the base plate is bent to form a dust case which is also used as a bearing for the spindles of the clock gear train, can be used and the pendulum rod retainer and guide according to this invention can be provided on the dust case of such construction.

Since in accordance with this invention the pendulum rod retainer is provided on the movement case itself, not only can the operations of immobilizing and releasing the pendulum rod be performed very easily, the possibility of loss or misplacement of the retainer can be eliminated completely. The immobilization of the pendulum rod by the device of the present invention is, moreover, much more reliable than that of the conventionally used clamps and resilient materials. As a result, there is no danger of the pendulum rod coming loose during transport so that damage to the clock by the pendulum rod can be completely eliminated.

Figure 8:
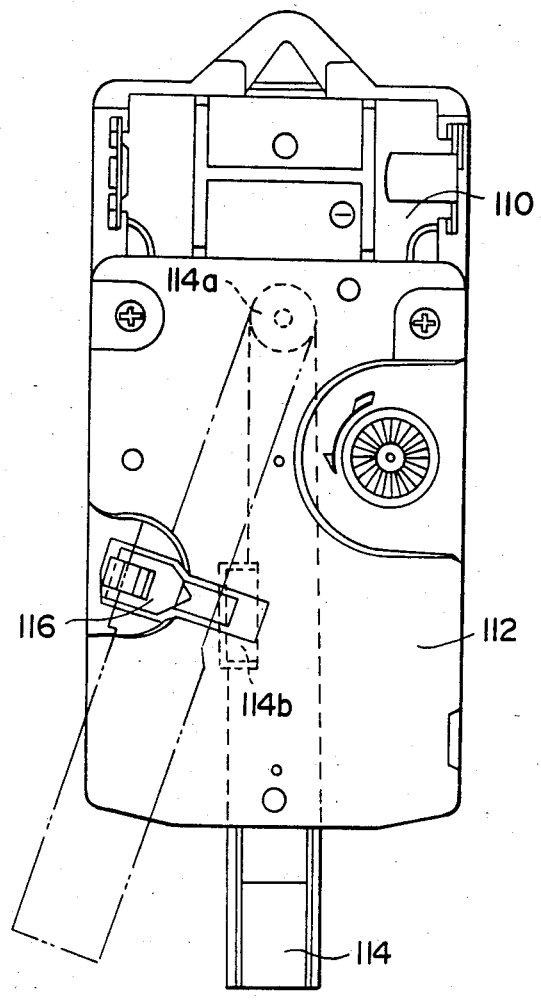
FIG. 8 is a plan view of a pendulum rod immobilizing device according to a third embodiment of the present invention.

FIG. 8 is a plan view of a fourth embodiment of the pendulum rod immobilizing device in accordance with the present invention.

As shown in the drawing, a clock movement is mounted on a base plate 110 and is enclosed by a case, in this embodiment a dust cover 112, to protect it against the intrusion of dust and the like. A pendulum rod 114 is suspendedly supported within the dust cover 112 in such a manner as to be swung by power received from a pendulum driving device provided separately of the clock movement. A pendulum bob (not shown) is provided at the other end of the pendulum rod 114.

Figure 9:
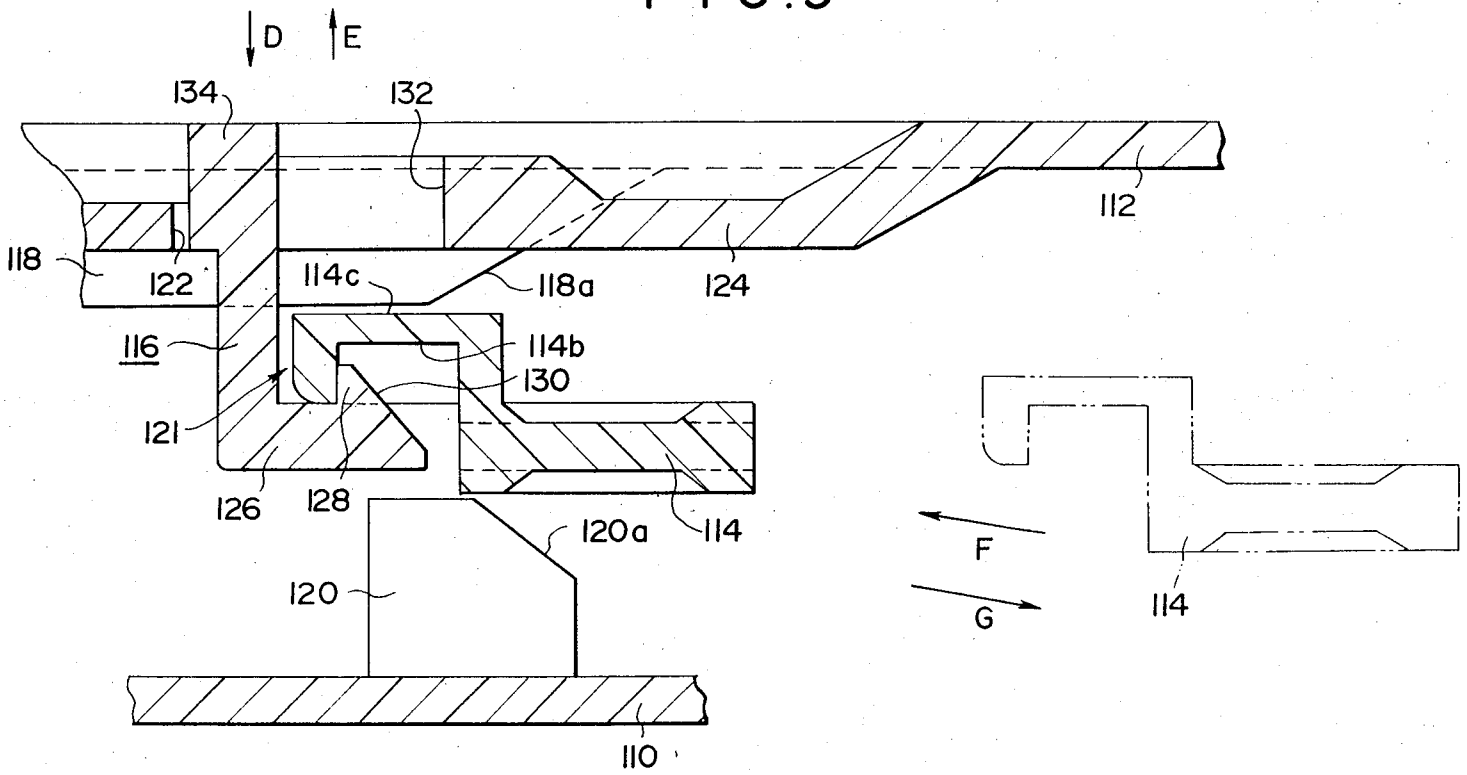
FIG. 9 is a sectional view of the device shown in FIG. 8 showing the pendulum rod in the immobilized state.

The dust cover 112 is formed of plastic and, as shown in FIG. 9, has formed integrally therewith a pendulum rod retainer 116 and a guide 118 for guiding the pendulum rod 114 into the pendulum rod retainer 116. A guide 120 is further provided on the base plate 110 at a position opposed to the guide surface of the guide 118.

The pendulum rod retainer 116 is formed within a through-hole 122 provided in the dust cover 112 and comprises a resilient member 124 formed as an extension of the dust cover 112 and having at the free end thereof a generally L-shaped catch 126. The catch 126 has a claw 128 for engagement with an engagement portion **114*b* of the pendulum rod 114 and a guide surface 130 for guiding the claw 128 into the engagement portion 114*b***.

Constructed in this way, the pendulum rod retainer 116 can be resiliently deformed in the direction of thickness of the dust cover 112, i.e. in the direction indicated by the arrow D.

The pendulum rod retainer 116 is further provided with a release member 134 for disengaging the claw 128 from the pendulum rod 114. In the illustrated embodiment, the release member 134 is formed as a rectangular protrusion on the opposite end of the pendulum rod retainer 116 from that on which the catch 126 is formed. It can therefore be easily pushed down in the direction of the base plate 110.

The guides 118 and 120 for guiding the pendulum rod 114 into the retainer 116 are located near the retainer 116 and the guide surfaces **118*a* and 128*a* together form an inlet guide opening in the direction of the pendulum rod 114. The height of the gap 121 between the guide 118 and the guide 120 is, as can be seen in FIG. 9, made only slightly larger than the combined height of the engagement portion 114*b* and the pendulum rod 114. As a result, when the pendulum rod 114 is in the immobilized state shown in FIG. 9**, it is not able to move in the directions indicated by the arrows D and E.

The pendulum rod retainer 116 is further provided with a peep hole 132 through which the claw 128 of the catch 126 can be observed from outside the dust cover 112. Therefore, when the pendulum rod is immobilized by the retainer 116, the rear side of the engagement portion **114*b* of the pendulum rod 114 can be observed through the peep hole 132**.

The operation of the pendulum rod immobilizing device in accordance with the third embodiment of the invention described above will now be explained.

In FIG. 9, the position of the pendulum rod 114 shown in chain lines is the position it occupies at one end of its swing in normal use.

When the completed watch is packed for shipment, the pendulum rod 114 is moved beyond the normal range of swing in the direction of the arrow F until the engagement portion **114*b* reaches the guides 118 and 120, whereafter it is further pushed in the same direction so as to cause the engagement portion 114*b* to be pushed upward in the direction of the arrow D. In consequence, the engagement portion 114*b* of the pendulum rod 114 is brought into the position indicated in solid lines in FIG. 9 and at the same time claw 128 snaps upward to resume its original position and immobilize the pendulum rod 114. As the pendulum rod 114 is at this time caught in the space between the guide 118 and the guide 120**, it is also prevented from moving in the directions of the arrows D and E.

The pendulum rod 114 is thus immobilized in the position shown in chain lines in FIG. 8 so as to be incapable of moving either in the direction of swing or in the direction perpendicular to the direction of swing. Moreover, when the pendulum rod is immobilized in this state, it is possible to view the rear face **114*c* of the engagement portion 114*b* through the peep hole 132 shown in FIG. 9. Therefore, if this rear face 114*c* is made a different color from that of the dust cover, it will be easy to distinguish between the state in which the pendulum rod 114 is immobilized by the retainer 116** and the state in which it is free from the retainer.

In order to free the pendulum rod 114 so as to put the clock in the state for use, it is only necessary to press the release member 134 shown in FIG. 9 in the direction of the arrow D. When this is done, the pendulum rod 114 will slip free of the claw 128 under its own weight and move in the direction of the arrow G into the normal state for use.

Figure 10:
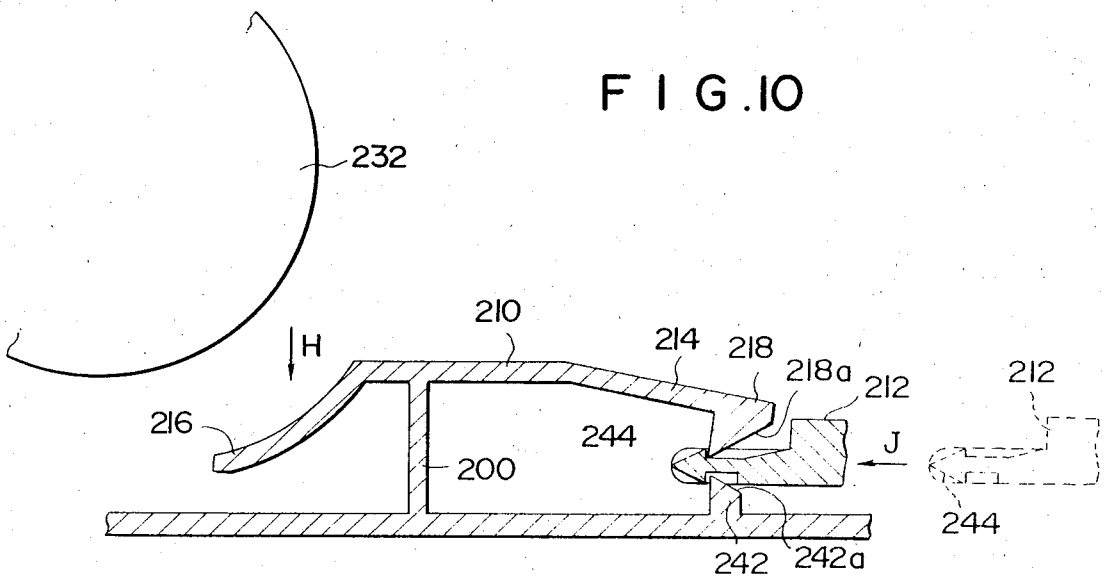
FIGS. 10 and 11 are explanatory views of a pendulum rod immobilizing device according to a fourth embodiment of the present invention showing the pendulum rod in the immobilized state and the released state, respectively.
Figure 11:
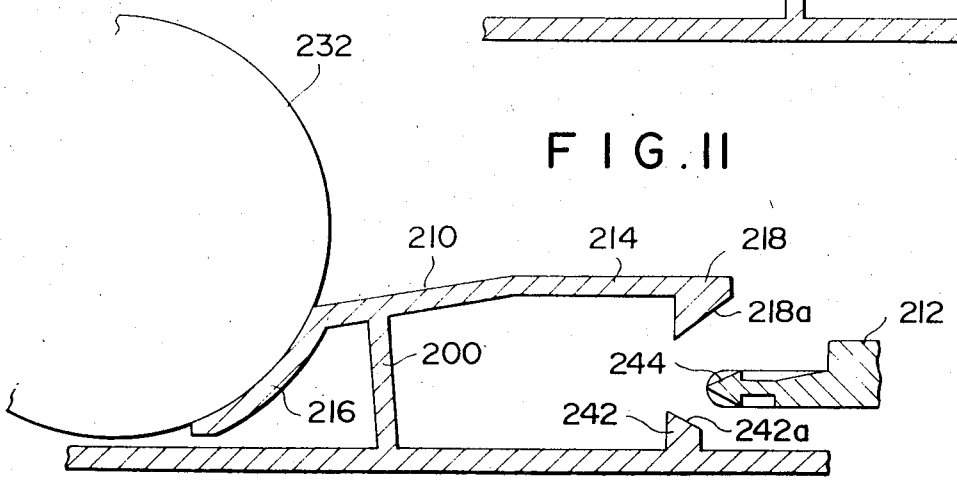

FIGS. 10 and 11 show a fourth embodiment of the pendulum rod immobilizing device according to the present invention.

As seen in FIG. 3, the device according to this fourth embodiment comprises a pendulum rod retainer 210 formed integrally with the dust case of the clock. The pendulum rod retainer 210 has resilient member 200 by which it is attached to the dust cover, a catch 214 for retaining the pendulum rod 212 and a release member 216 extending into a battery compartment of the clock. The pendulum rod 212 is immobilized by engagement with a claw 218 provided at the tip of the catch 214. One face of the claw 218 is inclined to form a guide face **218*a* for facilitating the operation of catching and immobilizing the pendulum rod 114**.

In this fourth embodiment, a retention column 242 having guide face **242*a* is disposed opposite the claw 218 of the catch 214. Moreover, the pendulum rod 244 is provided with an engagement portion 244 shaped like an arrow for engagement between the catch 214 and the retention column 242. The inclined guide surface 218***a*, the inclined guide surface 242*a* and the arrow-shaped engagement portion 244 cooperate to facilitate the operation of catching and retaining the pendulum rod 212.

The characterizing feature of this fourth embodiment is that it allows the pendulum rod 212 to be freed from its immobilized state by the insertion of a battery into the battery compartment of the clock, an operation which by necessity must be performed before the clock can be used. More specifically, when a battery 232 is inserted into the battery compartment it comes to bear down on the release member 216 in the direction of the arrow H thus causing the catch 214 to disengage from the pendulum rod 212.

The operation of the fourth embodiment of the pendulum rod immobilizing device described above will now be explained.

The operation of immobilizing the pendulum rod 212 is shown in FIG. 10. The pendulum rod 212 is pushed in the direction of the arrow J beyond the normal extremity of its swing indicated in dash lines. As a result, the engagement portion 244 first comes in contact with the guide face 218*a* and the guide face 242*a* and then, with further motion in the same direction, pushes up the catch 214 and passes thereunder, whereafter the catch 214 snaps back to its original position to securely catch the engagement portion 244 and immobilize the pendulum rod 212.

When the clock is to be put into use, the battery 232 is inserted into the battery compartment causing the release member 216 to be pushed down in the direction of the arrow H in FIG. 10. By this action, the resilient member 200 is resiliently deformed as shown in FIG. 11. Thus, the catch 214 is lifted out of engagement with the pendulum rod 212 to free the pendulum rod and allow it to move into the condition for normal use.

From this it is seen that in the fourth embodiment of the invention the release of the pendulum rod is accomplished simply by inserting a battery in the battery compartment of the clock. Therefore, the operation of releasing the pendulum rod can be accomplished quickly and easily without need for any manual operation in addition to those normally required to put the clock into a state for use.

We claim:

1. A pendulum rod immobilizing device in a clock of the type including a dust cover and a pendulum rod pivotally coupled to the dust cover, said immobilizing device comprising:

an opening in said cover comprising an elongated slot and a circular hole formed at and overlapping one end of said elongated slot;

a support member extending perpendicularly to and formed integrally with said dust cover adjacent an end of said elongated slot opposite said circular hole, said support member being made of a resilient material and comprising a three-prong shape with two outer prongs coupled to said dust cover on each side of said elongated slot and a center prong extending into said elongated slot;

a retainer member integrally formed on and perpendicular to said center prong of said support member, said retainer member being provided in said slot and lying substantially in a same plane as said dust cover;

a release member integrally formed with said retainer member and provided within said circular hole;

an L-shaped guide member integrally formed with said dust cover and having a long side of the L of the L-shaped guide member perpendicular to the dust cover;

a cylindrical pendulum rod catch integrally formed with said retainer member and extending perpendicularly from said retainer member toward a short side of the L of the L-shaped guide member;

a claw formed on the end of the cylindrical pendulum rod catch for engaging with an engagement hole formed in said pendulum rod; and a guide face formed on the short side of the L of the L-shaped guide member for guiding the pendulum rod into said immobilizing device.

* * * * *